United States Patent [19]

Knauschner et al.

[11] Patent Number: 4,628,718

[45] Date of Patent: Dec. 16, 1986

[54] METHOD OF ROLLING TO IMPART TRIANGULAR SECTION

[75] Inventors: Alfred Knauschner, Freiberg; Arno Hensel, Karl-Marx-Stadt; Alfons Dobrindt, Magdeburg, all of German Democratic Rep.

[73] Assignee: VEB Schwermaschinen-Bau Kombinat Ernst Thalmann, Magdeburg, German Democratic Rep.

[21] Appl. No.: 830,260

[22] Filed: Feb. 13, 1986

Related U.S. Application Data

[63] Continuation of Ser. No. 676,184, Nov. 29, 1984, abandoned, which is a continuation-in-part of Ser. No. 379,891, May 19, 1982, abandoned.

[51] Int. Cl.[4] ..... B21B 1/08

[52] U.S. Cl. ..... 72/199; 72/234; 72/366

[58] Field of Search ..... 72/197, 199, 221, 365, 72/366, 234; 29/527.7

[56] References Cited

U.S. PATENT DOCUMENTS 3,561,105 2/1971 Cofer ..... 29/527.7

FOREIGN PATENT DOCUMENTS 1176594 9/1961 Fed. Rep. of Germany .

152652 12/1979 Japan ..... 72/197

*Primary Examiner*—Francis S. Husar
*Assistant Examiner*—Steve Katz
*Attorney, Agent, or Firm*—Karl F. Ross; Herbert Dubno

[57] ABSTRACT

A rolling apparatus has a grooved roll rotatable about an axis, having an outer roll surface, and formed with a radially outwardly open groove having a pair of frustoconical groove flanks extending to the outer roll surface and spaced axially apart at the roll surface by a groove width. Juxtaposed with this grooved roll is a ridged roll rotatable about an axis parallel to the axis of the grooved roll and formed with a ridge engaging radially in the groove, and having an at least partially cylindrical outer ridge surface centered on the respective axis and a pair of annular axially oppositely directed ridge faces flanking the ridge outer surface. The ridge outer surface forms with the flanks of the groove a rolling opening extending perpendicular to a plane including the axes and having a maximum dimension measured parallel to the axes which is smaller than the groove width. The rolls are rotated oppositely about the respective axes and a workpiece having a maximum width measured parallel to the axes which is larger than the ridge width is fed to the opening in a direction perpendicular to the plane. More particularly the workpiece is oriented so that the sectional shape of same is upside down compared to the sectional shape of the opening.

2 Claims, 5 Drawing Figures

METHOD OF ROLLING TO IMPART TRIANGULAR SECTION

CROSS REFERENCE TO RELATED APPLICATION

This is a continuation of co-pending application Ser. No. 676,184 filed on Nov. 29, 1984, and now abandoned, which is a continuation-in-part of copending patent application Ser. No. 379,891 filed May 19, 1982 (now abandoned).

FIELD OF THE INVENTION

The present invention relates to a roll stand. More particularly this invention concerns such a roll stand and method of operating same to impart triangular section to the workpiece being rolled.

BACKGROUND OF THE INVENTION

It is standard practice in the size-reduction rolling of a steel strand for the formation of billets, wire, or the like to form the two rolls of each roll stand with radially facing grooves forming an opening through which the workpiece passes. A plurality of such two- or three-high roll stands are arranged in a row with the openings horizontally aligned, and, relative to the normal transport direction of the strand through the stands, the openings are of decreasing cross section. Thus the workpiece is squeezed and stretched as it passes through the succession of stands.

German Pat. No. 1,073,990 describes a triplex roll stand wherein the workpiece starts out with round or triangular section and is passed between three rolls which extend at 120° to each other to form an opening shaped as an equilateral triangle. Such an arrangement allows considerable size reduction in theory, but this possibility is hard to realize because the roll diameter is limited due to the difficulties of mounting the rolls. Also it is fairly difficult to synchronously drive the three rollss, whose surfaces must all move in the same direction and at the same peripheral speed in the opening they form.

Another system for imparting triangular section to a workpiece in a roll stand is described in German patent document 1,176,594. Here only two rolls rotatable about parallel vertically spaced axes are employed so that large roll diameters can be used and so that driving the rolls synchronously is relatively simple. One of the rolls is formed with a V-section groove having a pair of frustoconical flanks flaring radially outward. These two flanks form two sides of a triangular opening whose third side is formd by the cylindrical outer surface of the other roll.

Japanese Pat. No. 54,152,652 assigned to Tanaka has a pair of mainly cylindrical rollers, one of which is formed with a circumferential square-section groove and the other of which is formd with a circumferential square-section groove. A large-diameter ring rides in the groove and serves to strip a workpiece rolled in it from the grooved roller.

The main problem with these arrangements is that the workpiece can only have, measured parallel to the roll axes, a maximum width which is at most as large as the maximum width of the groove, measured axially at the outer surface of the grooved roll. As a result only limited size reduction is possible, so that a great many rolling stands are needed to obtain a size reduction which could theoretically be effected in fewer passes.

Any attempt to force too large a workpiece through such a roll stand results inevitably in a burr which cannot be tolerated in a high-quality rolled product.

OBJECTS OF THE INVENTION

It is therefore an object of the present invention to provide an improved method of operating a rolling apparatus so as to give the workpiece triangular section.

Another object is the provision of such a rolling method which can impart an at least generally triangular section to a workpiece whose maximum width is substantially greater than the corresponding width of the opening formed by the rolls.

SUMMARY OF THE INVENTION

These objects are attained according to the instant invention by means of a rolling apparatus having a grooved roll rotatable about an axis, having an outer roll surface, and formed with a radially outwardly open groove having a pair of frustoconical groove flanks extending to the outer roll surface and spaced axially apart at the roll surface by a groove width. Juxtaposed with this grooved roll is a ridged roll rotatable about an axis parallel to the axis of the grooved roll and formed with a ridge engaging radially in the groove, and having an at least partially cylindrical outer ridge surface centered on the respective axis and a pair of annular axially oppositely directed ridge faces flanking the ridge outer surface. The ridge outer surface forms with the flanks of the groove a rolling opening extending perpendicular to a plane including the axes and having a maximum dimension measured parallel to the axes which is smaller than the groove width.

In accordance with this invention the rolls are rotated oppositely about the respective axes and a workpiece having a maximum width measured parallel to the axes which is larger than the ridge width is fed to the opening in a direction perpendicular to the plane. More particularly the workpiece is oriented so that the sectional shape of same is upside down compared to the sectional shape of the opening. This reversal of the workpiece section with each rolling operation is excellent for thorough cold working of the workpiece, giving the finished product great strength.

It is possible to achieve this end in a system having two roll stands by orienting one of the grooved rolls of one stand above the respective ridged roll and the other grooved roll below the respective ridged roll with the roll-stand planes parallel and the openings substantially aligned.

It is therefore possible with this system to roll a workpiece having a maximum width greater than the ridge width, which is the maximum axial dimension of the opening, and smaller than the groove width, which is normally substantially greater than the ridge width. Thus workpiece size can be reduced considerably, necessitating fewer roll stands to obtain a given product section from a workpiece of larger section.

According to another feature of this invention the groove flanks meet. Thus the opening is substantially triangular in section. It is also possible for the groove to have a cylindrical base from which the flanks extend, in which case the opening is trapezoidal in section.

A roll stand as described above can be combined in accordance with another feature of the invention with a second such roll stand of substantially identical construction. In this arrangement, however, one of the grooved rolls is above the respective ridge roll and the other of the grooved rolls is below the respective ridged roll. The planes of the axes of the two stands are parallel and the openings are substantially aligned. More particularly the openings are vertically offset slightly from each other so that the workpiece passes without bending straight from the upstream stand to the downstream stand, thereby reducing unnecessary lateral stresses on the equipment.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
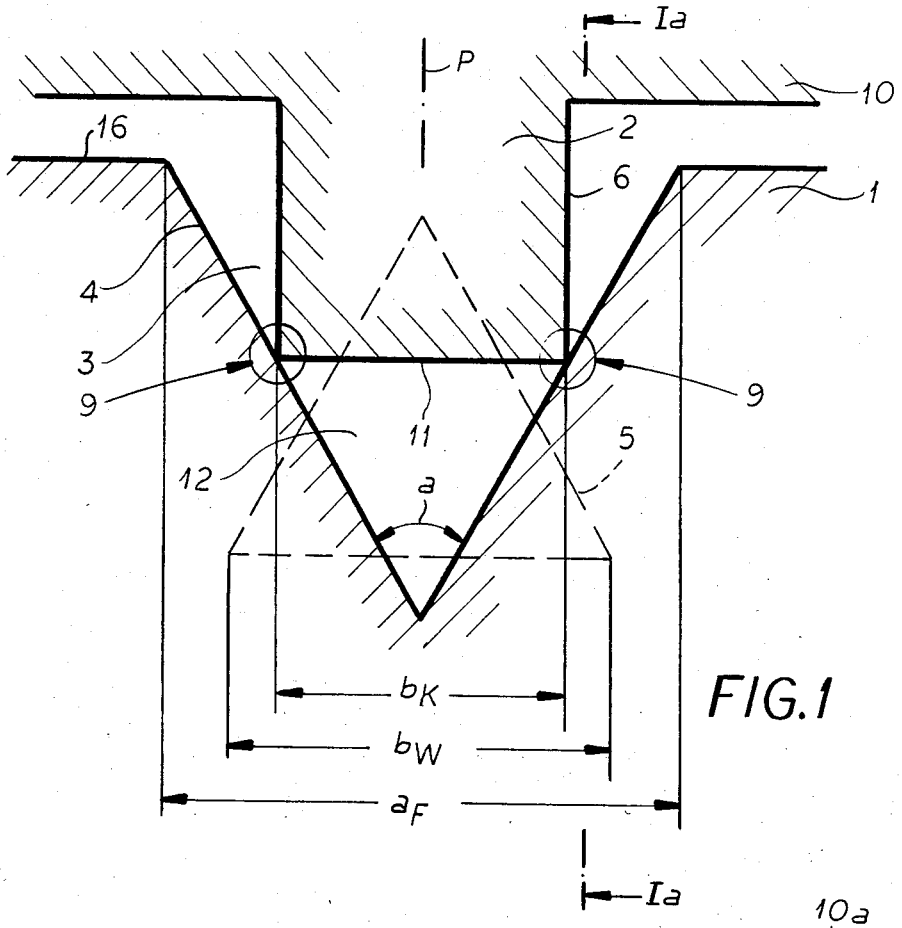
FIG. 1 is an axial end view of the nip of a roll pair according to this invention.

As seen in FIG. 1 a lower roll 1 centered on an axis A (see FIG. 1*a*) has a cylindrical outer surface 16 and is formed with a V-section radially outwardly open groove 3 having a pair of fructoconical flanks 4 forming an angle of a 60° with each other and symmetrical about a plane P perpendicular to the axis A of the roll 1. An upper roll 10 rotatable about an axis A′ (see FIG. 1*a*) parallel to that of the lower roll 1 and forming a vertical plane P′ therewith is formed with a square-section ridge 2 that is also centered on the plane P and that engages radially in the groove 3. This ridge 2 has a cylindrical outer face 11 and parallel annular side faces 6 that form corners 9 that in turn engage the respective flanks 4 about midway. The groove 3 has an axial length $a_F$ measured at its widest point on the cylindrical surface of the roll 1 and the ridge 2 has an axial length $b_K$ which is equal to about two-thirds the length $a_F$. The dimension $b_K$ therefore defines the widest part of the triangular opening 12 formed by the surfaces 4 and 11.

A steel strand workpiece 5 of equilateral-triangular section has a base dimension $b_W$ which is equal to more than the ridge width $b_K$ but less than the groove width $a_F$. This strand 5 is fed to the triangular opening 12 formed by the surfaces 4 and 11 in the dashed-line illustrated position which is upside down relative to the shape of this opening 12. Thus two corners of the workpiece 5 will first engage the flanks 4 at a location radially outside the locations where the corners 9 subsequently engage, and the other corner will centrally engage the surface 11 of the ridge. This will lap over the corners engaging the flanks 4 as the profile of the workpiece 5 is reversed.

Figure 1A:
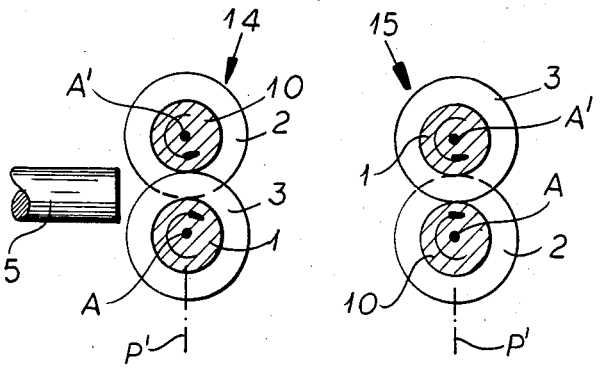
FIG. 1*a* is a small scale side view of a rolling system incorporating two roll stands according to the present invention, the section being taken along the crosswise plane indicated at I*a*—I*a* in FIG. 1.

FIG. 1*a* shows how one roll stand 14 identical to that of FIG. 1 is associated with another stand 15 which is identical to FIG. 1 also, but upside down, that is with its roll 1 up and its roll 10 down. The openings 12 are generally in line perpendicular to the respective planes P′, with the downstream roll stand 15 slightly lower than the upstream roll stand 14 so that the workpiece 5 is not bent up or down as it passes from stand to stand.

Figure 2:
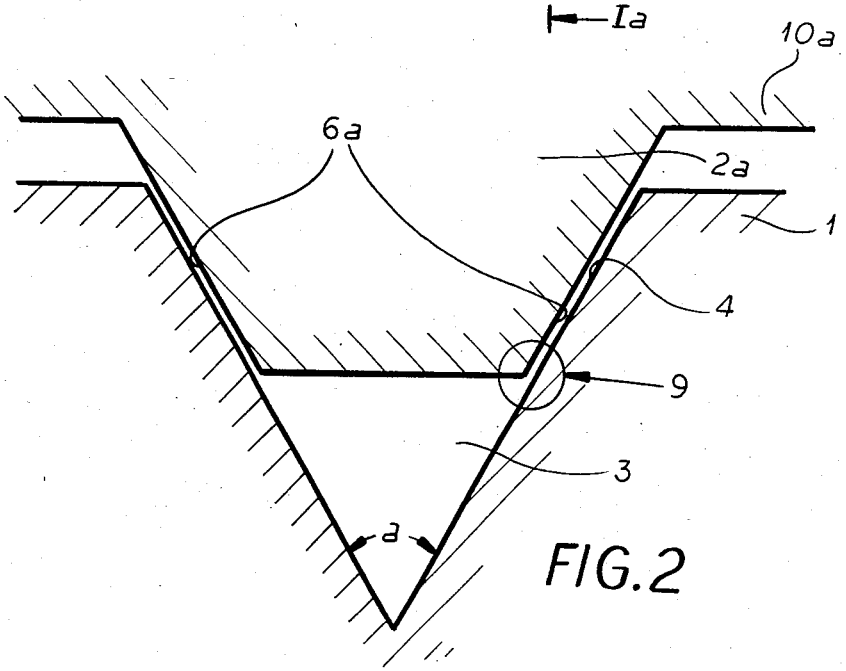
FIGS. 2–4 are further views like FIG. 1 showing further roll pairs in accordance with the instant invention.

In FIG. 2 the arrangement has an upper roll 10*a* formed with a trapezoidal-section ridge 2*a* whose two side flanks 6*a* are frustoconical and form the same angle a as the groove 3. Thus these side flanks 6*a* will fit snugly against the flanks 4 of the groove 3. This helps the two rolls to maintain perfect axial position with respect to each other, and eliminates the possibility of damage to the flanks 4 by the corners 9.

Figure 3:
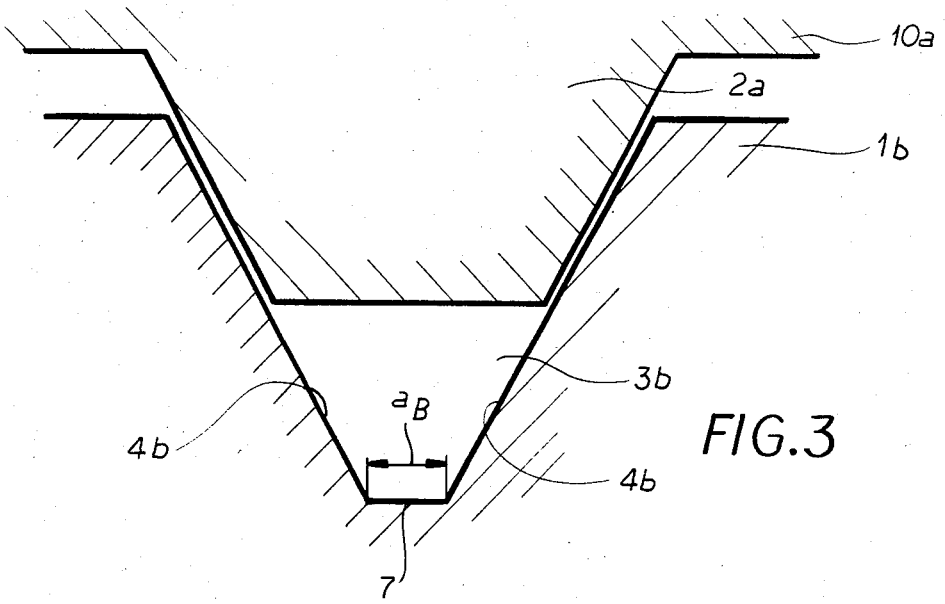

The arrangement of FIG. 3 has an upper roll 10*a* identical to that of FIG. 2, but a lower roll 1*b* having a groove 3*b* whose flanks 4*b* extend at an angle a of 60° to each other but which do not meet at a point. Instead the flanks 4*b* meet at a cylindrical base surface 7 having an axial dimension $a_B$ equal to about one-eighth of the dimension $a_F$. This arrangement will impart to the incoming workpiece an isosceles-trapezoidal section.

Figure 4:
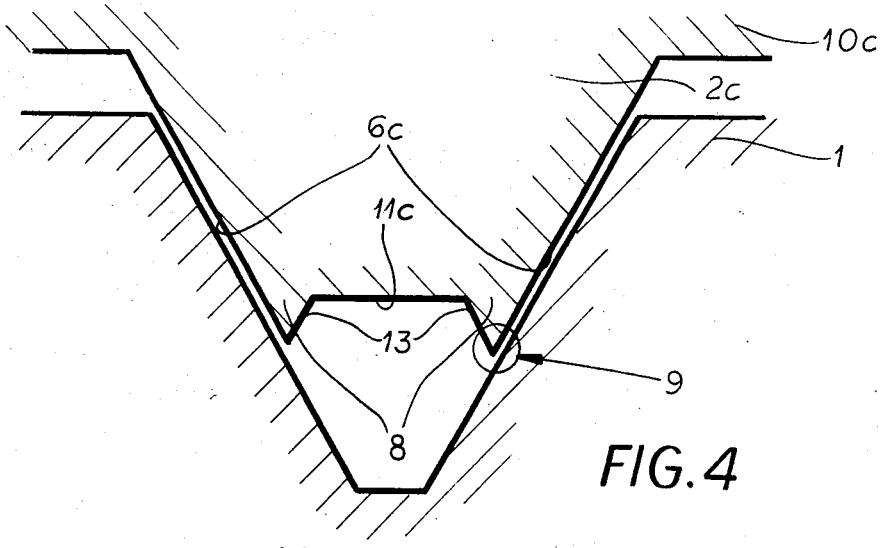

The system of FIG. 4 has a lower roll 1*b* identical to that of FIG. 3, and an upper roll 10*c* having a ridge 2*c* formed with a pair of pointed extensions 8 having outer flanks forming extensions of the side faces 6*c* and inner flanks 13 which extend at 60° to the flanks 6*c* and that terminate at the outer cylindrical surface 11*c* of the ridge 2*c*. This arrangement will form the incoming workpiece into a hexagon whose sides alternate short and long so that the workpiece still is basically triangular, but with chamfered corners.

It is possible with the system according to the instant invention, therefore, for the workpiece cross section to be reduced substantially with each pass between the rolls. Great rolling force can be employed to greatly reduce workpiece size with each pass, thereby thoroughly cold-working the workpiece. The use of a ridge fitting into a groove makes it possible for the rolls to accept a workpiece of substantially greater cross secton than that of the opening formed by the rolls, something that was impossible in grooved rolls known to date which could only produce a minor reduction in workpiece cross section. Even if the workpiece is of round section, it will engage three surfaces between the two rolls and be transformed into the desired polygonal shape.

We claim:

1. A method of operating a rolling apparatus comprising:

a grooved roll
rotatable about an axis,
having an outer roll surface, and
formed with a radially outwardly open groove having a pair of frustoconical and meeting groove flanks extending to the outer roll surface and spaced axially apart at the roll surface by a groove width; and a ridged roll rotatable about an axis parallel to the axis of the grooved roll and formed with a ridge engaging radially in the groove, and
having an at least partially cylindrical outer ridge surface centered on the respective axis and a pair of annular axially oppositely directed ridge faces flanking the ridge outer surface, the ridge outer surface forming the flanks of the groove a substantially triangular rolling opening extending perpendicular to a plane including the axes and having a maximum ridge width measured parallel to the axes which is smaller than the maximum groove width, the method comprising the steps of:

rotating the rolls oppositely about the respective axes;

feeding to the opening in a direction perpendicular to the plane a substantially triangular-section workpiece having a maximum width measured parallel to the axes which is larger than the ridge width and smaller than said maximum groove width; and orienting the workpiece so the sectional shape of same is upside down compared to the sectional shape of the opening.

2. The method defined in claim 1 wherein the apparatus further comprises:

a second such grooved roll rotatable about an axis, having an outer roll surface, and formed with a radially outwardly open groove having a pair of frustoconical groove flanks extending to the respective outer roll surface and spaced axially apart at the respective roll surface by a groove width; and a second such ridged roll rotatable about an axis parallel to the axis of the respective grooved roll and formed with a ridge engaging radially in the groove of the second grooved roll, and having an at least partially cylindrical outer ridge surface centered on the respective axis and a pair of annular axially oppositely directed ridge faces flanking the respective ridge outer surface, the ridge outer surface of the second ridged roll forming with the flanks of the respective groove a second rolling opening extending perpendicular to a plane including the respective axes and having a maximum dimension measured parallel to the respective axes which is smaller than the respective groove width, the method further comprising the step of orienting one of the grooved rolls above the respective ridged roll and the other of the grooved rolls below the respective ridged roll with the planes parallel and the openings substantially aligned.

* * * * *